US012371902B2

(12) United States Patent
Game et al.

(10) Patent No.: US 12,371,902 B2
(45) Date of Patent: Jul. 29, 2025

(54) PARTITION SYSTEM

(71) Applicant: Evans Consoles Corporation, Calgary (CA)

(72) Inventors: Richard Game, Calgary (CA); Carlos Renderos, Calgary (CA); Matco Papic, Calgary (CA); Andrew Cowie, Calgary (CA)

(73) Assignee: Evans Consoles Corporation, Calgary (CA)

( * ) Notice: Subject to any disclaimer, the term of this patent is extended or adjusted under 35 U.S.C. 154(b) by 579 days.

(21) Appl. No.: 17/470,610

(22) Filed: Sep. 9, 2021

(65) Prior Publication Data

US 2022/0074200 A1 Mar. 10, 2022

Related U.S. Application Data

(60) Provisional application No. 63/076,720, filed on Sep. 10, 2020.

(51) Int. Cl.

| | |
|---|---|
| ***E05D 3/12*** | (2006.01) |
| ***E04B 2/74*** | (2006.01) |
| ***E04B 2/78*** | (2006.01) |

(52) U.S. Cl.

CPC ..... *E04B 2/7442* (2013.01); *E04B 2/7872* (2013.01); *E04B 2/789* (2013.01); *E04B 2002/7464* (2013.01)

(58) Field of Classification Search

CPC .. G09F 15/0068; E04B 2/7405; E04B 2/7416; E04B 2/7425; E04B 2/7427; E04B 2/7429; E04B 2002/7464; E04B 2/789; E04B 2/7872; E04B 2/7431; E04B 2/7442; E05D 3/12

USPC ..... 160/351, 352, 353

See application file for complete search history.

(56) References Cited

U.S. PATENT DOCUMENTS

| | | | |
|---|---|---|---|
| 543,906 | A | 8/1895 | Spaulding |
| 3,605,851 | A | 9/1971 | Miles |
| 3,696,855 | A | 10/1972 | Kira |
| 3,762,116 | A | 10/1973 | Anderson |
| 3,889,315 | A | 6/1975 | Stouffer |

(Continued)

FOREIGN PATENT DOCUMENTS

| | | | |
|---|---|---|---|
| EP | 0168354 | A1 | 1/1986 |
| GB | 2159573 | A | 12/1985 |

*Primary Examiner* — Daniel P Cahn
*Assistant Examiner* — Matthew R. Shepherd
(74) *Attorney, Agent, or Firm* — Notaro, Michalos & Zaccaria P.C.

(57) ABSTRACT

A partition system has at least one pivot joint, each pivot joint having two pivot structures with partial circular cross-sections centered on a pivot axis. Each pivot structure engages with one of a plurality of wall panels and permits the engaged wall panel to pivot about the pivot axis. A linking structure extends between and joins the two pivot structures. A stop member extends outwardly from the linking structure to limit a range within which the wall panels can pivot about the pivot axis. Each of the wall panels has a pair of parallel tabs extending substantially perpendicularly from at least one end face of the wall panel. At least one parallel tab has an end flange extending inwardly toward the second tab. The end flange snap fit onto one of the pivot structures. Each of the wall panels is pivotally connected to the at least one pivot joint.

6 Claims, 6 Drawing Sheets

(56) References Cited

U.S. PATENT DOCUMENTS

| | | | | | |
|---|---|---|---|---|---|
| 3,889,736 | A * | 6/1975 | Firks | E04B 2/7429 | 16/225 |
| 4,103,465 | A * | 8/1978 | McDonald, Jr. | G09F 15/0068 | 52/475.1 |
| 4,594,829 | A * | 6/1986 | Herrgord | E05D 1/04 | 52/282.3 |
| 4,601,145 | A * | 7/1986 | Wilcox | E04B 2/7444 | 52/239 |
| 4,606,394 | A * | 8/1986 | Bannister | E04B 2/7416 | 52/239 |
| 4,774,792 | A * | 10/1988 | Ballance | F16B 2/22 | 52/239 |
| 4,821,382 | A * | 4/1989 | Puschkarski | E05D 1/04 | 24/339 |
| 4,828,005 | A * | 5/1989 | Notley | E04B 2/7427 | 160/351 |
| 5,220,951 | A * | 6/1993 | Dagenais | E05D 1/04 | 160/199 |
| 5,287,909 | A * | 2/1994 | King | A47G 5/00 | 160/229.1 |
| 5,363,612 | A * | 11/1994 | Erickson | G09F 15/0068 | 403/403 |
| 6,599,055 | B2 * | 7/2003 | Auer | E04B 2/7427 | 403/381 |
| 9,062,484 | B2 * | 6/2015 | Miller | E05D 3/12 | |
| 2006/0254176 | A1 * | 11/2006 | Tsai | E04B 2/7424 | 52/481.2 |
| 2014/0367056 | A1 * | 12/2014 | Miller | E05D 3/12 | 16/221 |

* cited by examiner

PARTITION SYSTEM

CROSS-REFERENCE TO RELATED APPLICATIONS

This application claims priority from U.S. Provisional Patent Application No. 63/076,720, filed on Sep. 10, 2020, which is incorporated by reference for all purposes.

FIELD OF THE DISCLOSURE

The present disclosure relates to partition systems. More specifically, the present disclosure relates to adjustable partition systems.

BACKGROUND

Partition systems are commonly used in control rooms, trading floors, operation centers, and other commercial settings to divide a large area into smaller, separate workspaces. Partition systems provide users with some privacy and reduce noise and other distractions, thereby potentially increasing workplace productivity and improving worker mental health.

Many traditional partition systems come with numerous different pieces and parts, which make it more difficult and time-consuming to assemble. Further, many existing systems are not easily customizable in terms of size, shape, or configuration. Once assembled, the relative angle between the partition walls cannot be modified without partially disassembling the partition system, adjusting the angle, and reassembling the partition system in order to achieve the desired configuration, which is labour-intensive and thus has cost implications.

Accordingly, there is a need for a partition system that is quick and easy to assemble, with relatively few parts, and can be easily adjusted to accommodate the needs of the user and the physical workspace.

SUMMARY

In at least one embodiment, the present disclosure provides a pivot joint for connecting partition wall panels, comprising two pivot structures having partial circular cross-sections centered on a pivot axis, each pivot structure for engaging with a wall panel and permitting an engaged wall panel to pivot about the pivot axis; a linking structure extending between and joining the two pivot structures; and a stop member extending outwardly from a proximal end at the linking structure to a distal end spaced apart from the linking structure, the stop member limiting the range within which wall panels engaged with the pivot structures can pivot about the pivot axis.

In some embodiments, the stop member comprises a perpendicular cross member at the distal end thereof, the stop member having a T-shaped cross-section.

In some embodiments, the stop member further comprises a pair of flanges extending from ends of the perpendicular cross member.

In some embodiments, the pivot joint is a metal extrusion, such as an aluminum extrusion.

The present disclosure further provides a tab connector for connecting a wall panel to a pivot joint, the tab connector comprising connector means for securing the tab connector to an end face of a wall panel, and a pair of parallel tabs extending outwardly from the connector means, at least one of said tabs having an end flange extending inwardly toward the other of said tabs, the end flange being adapted to engage the pivot joint.

In some embodiments, the tab connector is a metal extrusion, such as an aluminum extrusion.

The present disclosure further provides a partition system comprising at least one pivot joint, each at least one pivot joint comprising: two pivot structures having partial circular cross-sections centered on a pivot axis, each pivot structure for engaging with a wall panel and permitting an engaged wall panel to pivot about the pivot axis; a linking structure extending between and joining the two pivot structures; and a stop member extending outwardly from a proximal end at the linking structure to a distal end spaced apart from the linking structure, the stop member limiting the range within which wall panels engaged with the pivot structures can pivot about the pivot axis, the partition system further comprising a plurality of wall panels, each of said wall panels comprising a pair of parallel tabs extending substantially perpendicularly from at least one end face of the wall panel, at least one of said parallel tabs having an end flange extending inwardly toward the other of said tabs, the end flange being adapted to engage one of the pivot structures of the at least one pivot joint, each of the plurality of wall panels being pivotally connected to the at least one pivot joint.

In some embodiments, the pair of parallel tabs of the plurality of wall panels comprises a tab connector, comprising connector means for securing the tab connector to an end face of a wall panel, and a pair of parallel tabs extending outwardly from the connector means, at least one of said tabs having an end flange extending inwardly toward the other of said tabs, the end flange being adapted to engage the at least one pivot joint.

In some embodiments, the at least one pivot joint and the tab connectors are metal extrusions, such as aluminum extrusions.

BRIEF DESCRIPTION OF THE DRAWINGS

Aspects and embodiments of the disclosure will now be described in greater detail with reference to the accompanying diagrams, in which.

DETAILED DESCRIPTION OF THE EMBODIMENTS

It is contemplated that the present disclosure provides an adjustable partition system that can be assembled and configured to accommodate the needs of the user and the physical workspace.

Figure 1:
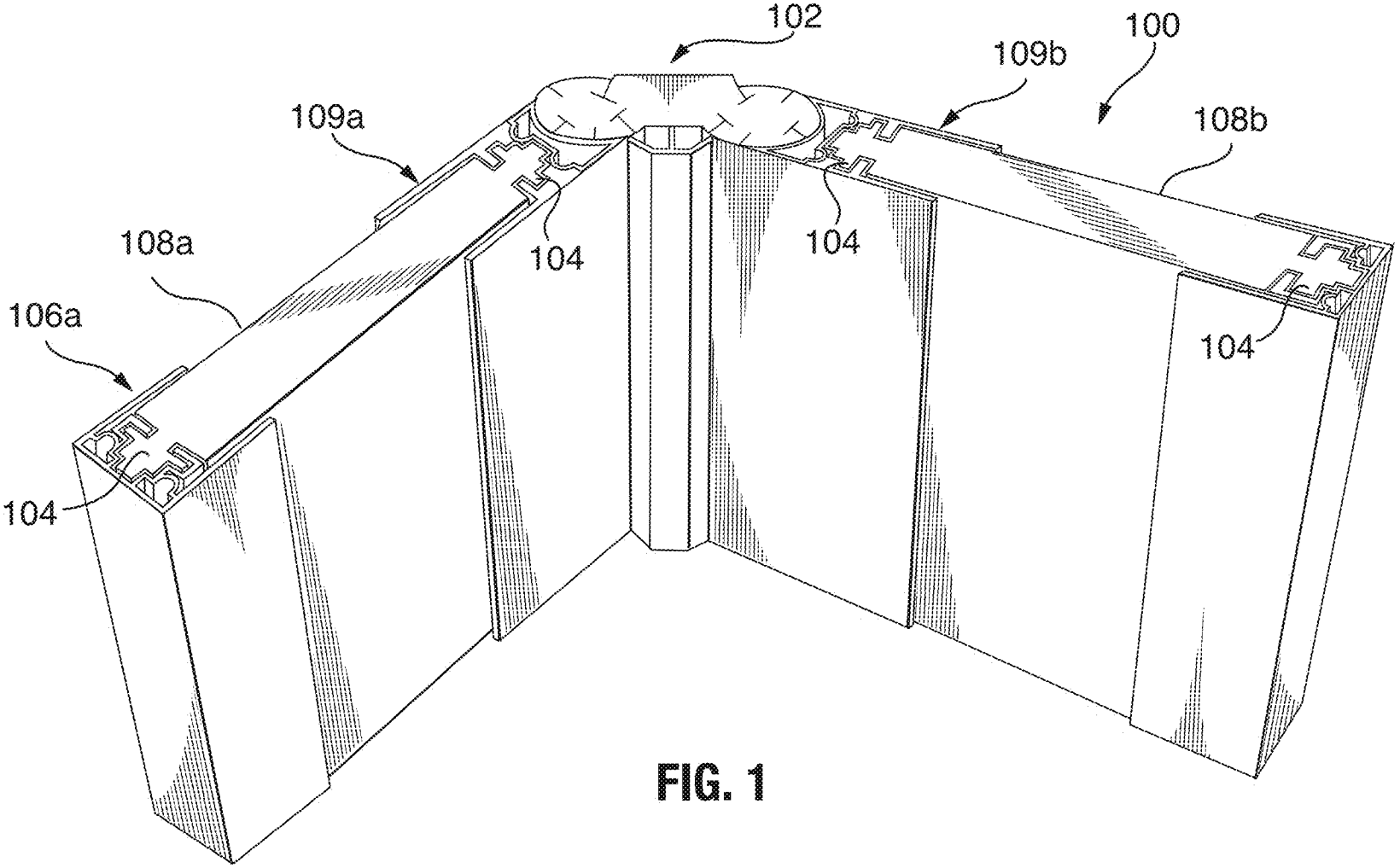
FIG. 1 is a perspective view of a partition system in accordance with an embodiment of the present invention.

FIG. 1 is a perspective view of a partition system 100 according to an embodiment of the present invention. Partition system 100 is comprised of a pivot joint 102, partition wall panels 108*a*, 108*b* and tab connectors 109*a*, 109*b*. The partition wall panels 108*a*, 108*b* may be manufactured using any suitable materials, such as, but not limited to, particleboard, foam, acrylic, plastic and glass, and may be manufactured using any suitable manufacturing technique as will be readily appreciated by the skilled person. Partition wall panels 108*a*, 108*b* have end faces 104 to which the tab connectors 109*a*, 109*b* or end frame members 106*a*, 106*b* are secured. The tab connectors 109*a*, 109*b* are adapted to engage the pivot joint 102.

Figure 2:
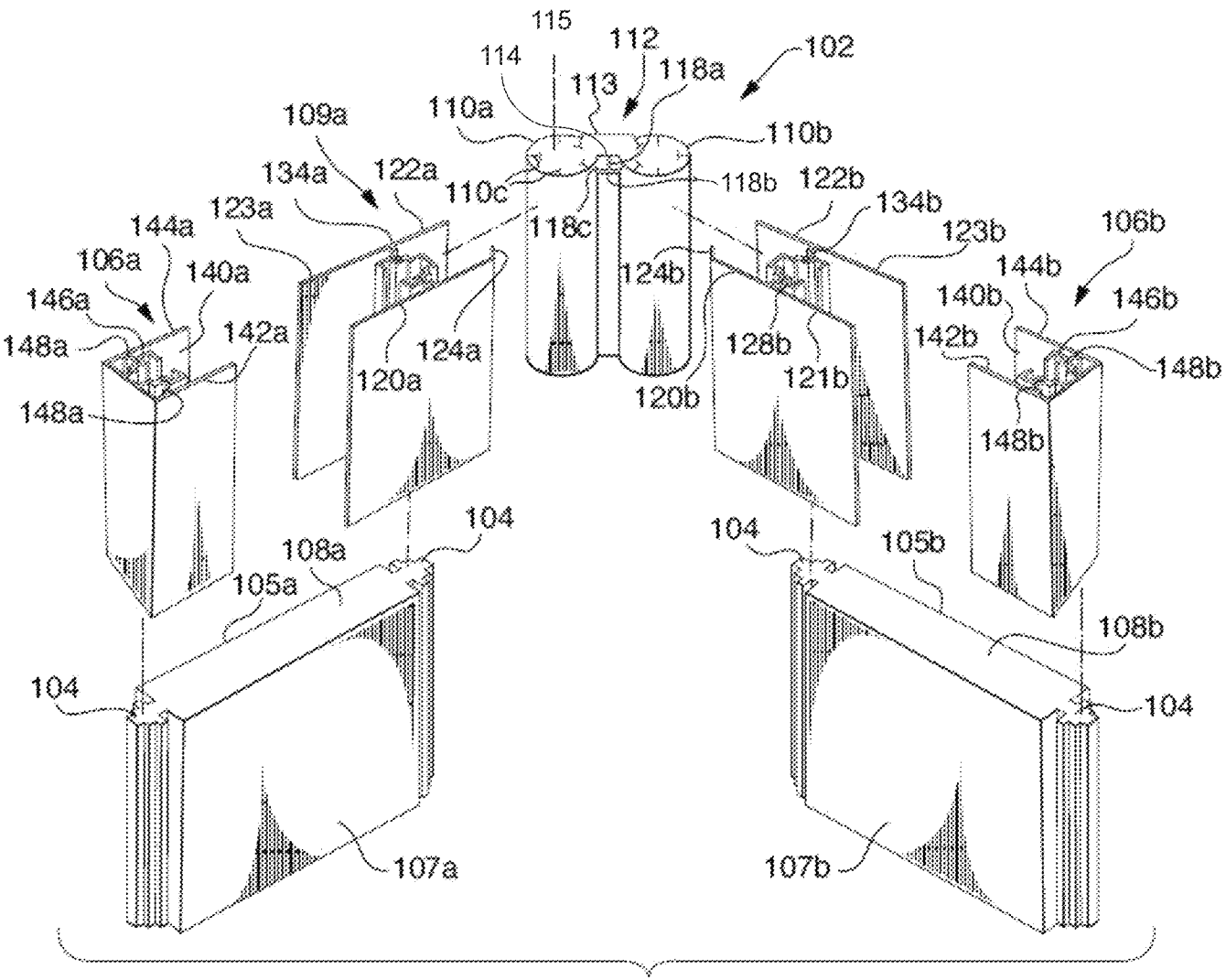
FIG. 2 is an exploded perspective view of the partition system of FIG. 1.

FIG. 2 is an exploded view of the partition system 100. The pivot joint 102 has two pivot structures 110*a*, 110*b*, each being roughly cylindrical and having partial circular cross-sections centered on a pivot axis 115. Each of the pivot structures 110*a*, 110*b* engage with one of the partition wall panels 108*a*, 108*b*, permitting the engaged wall panel 108*a*, 108*b* to pivot about the pivot axis 115. The pivot structures 110*a*, 110*b* have a series of internal flanges 110*c* extending inwardly toward the pivot axis 115.

A linking structure 112 extends between and joins the two pivot structures 110*a*, 110*b*. In the illustrated embodiment, the linking structure 112 includes an outer linking edge 113 and an inner linking edge 114, each formed integrally with the pivot structures 110*a* and 110*b*.

A stop member 118 extends outwardly from the linking structure 112 to limit the range within which wall panels 108*a*, 108*b*, which are engaged with the pivot structures 110*a*, 110*b*, can pivot about the pivot axis 115, as explained in greater detail below. In the illustrated embodiment, the stop member 118 extends outwardly from the inner linking edge 114. In this embodiment, the stop member has a T-shaped cross-section, with a body 118*a* extending outwardly from a proximal end at the inner linking edge 114 to a distal end spaced apart from the inner linking edge 114. The stop member 118 also has a perpendicular cross member 118*b* extending from the distal end of the body 118*a*, parallel to the inner linking edge 114. The stop member 118 also has a pair of flanges 118*c* extending from the ends of the perpendicular cross member 118*b*, toward the inner linking edge 114.

In some embodiments, the pivot joint 102 is formed as a metal extrusion, such as, but not limited to, an aluminum extrusion. In such embodiments, the pivot structures 110*a* and 110*b*, the internal flanges 110*c*, the outer linking edge 113, the inner linking edge 114, the stop member body 118*a*, the stop member perpendicular cross member 118*b* and the flanges 118*c* are all formed integrally as one piece of extruded aluminum.

The partition wall panels 108*a*, 108*b* each have an inside wall face 107*a*, 107*b* and an outside wall face 105*a*, 105*b*. Each of the end faces 104 extend from an end of the inside wall face 107*a*, 107*b* to a corresponding end of the outside wall face 105*a*, 105*b*. In the illustrated embodiment, the end faces 104 are formed as shown in FIG. 2. This form is the inverse form of ports 128*a*, 128*b* of the tab connectors 109*a*, 109*b*, such that said tab connectors 109*a*, 109*b* can slide onto the end faces 104, the end faces 104 being securely received in ports 128*a*, 128*b* of the tab connectors 109*a*, 109*b* as shown in FIG. 1. The tab connectors 109*a*, 109*b* are described in greater detail below.

In other embodiments of the invention (not shown), end faces 104 can be of any shape or form, such as a rectangle, extending from the inside wall face 107*a*, 107*b* to the outside wall face 105*a*, 105*b*. In such embodiments, the tab connectors 109*a*, 109*b* rely on other any other suitable connecting means to connect to the end faces 104 of the partition wall panels 108*a*, 108*b*. By way of example, the tab connectors 109*a*, 109*b* can connect by way of a friction fit using a pair of opposed connecting flanges (not shown) that extend from the tab connector 109*a*, 109*b* to receive and grip a partition wall panel 108*a*, 108*b*.

Figure 5:
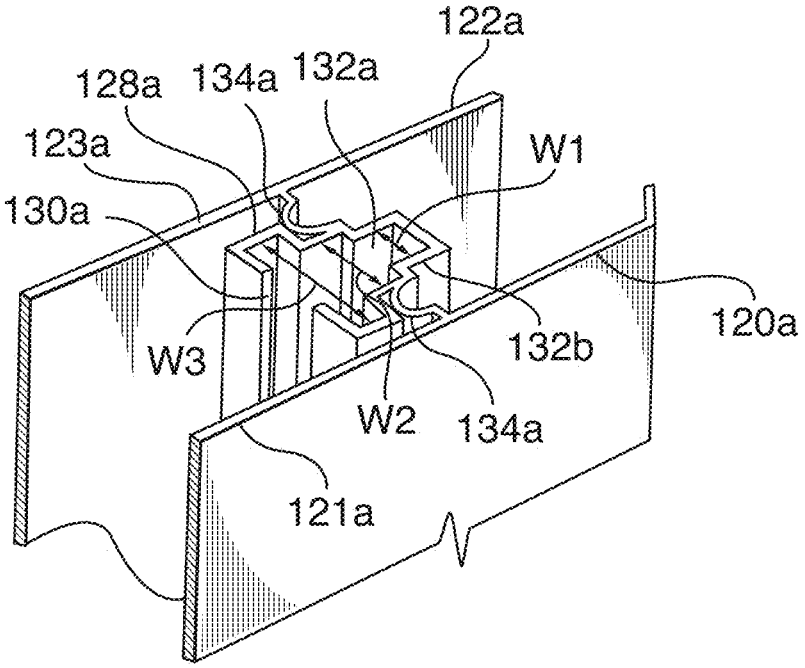
FIG. 5 is a perspective view of the tab connector of the partition system of FIG. 1.

The tab connectors 109*a*, 109*b* comprise a pair of parallel tabs 120*a*, 120*b*, 122*a*, 122*b* for engaging the pivot joint 102. In the illustrated embodiment, the tabs 120*a*, 120*b*, 122*a*, 122*b* are formed integrally with the tab connectors 109*a*, 109*b*, as shown in FIG. 5, and extend from the end faces 104*a*, 104*b* when end faces 104*a*, 104*b* are securely received in port 128*a*, 128*b* of pivot arm extrusions. However, it will be appreciated that the tabs 120*a*, 120*b*, 122*a*, 122*b* can be connected to, and extend from the end faces 104*a*, 104*b* in any suitable manner, or could be formed integrally with the wall panels 108*a*, 108*b*. The tabs 120*a*, 120*b*, 122*a*, 122*b* extend outwardly from the end face 104*a*, 104*b* and substantially parallel to the inside wall face 107*a*, 107*b* and the outside wall face 105*a*, 105*b*.

At least one of the tabs has an end flange adapted to engage the pivot joint. In FIG. 2, tabs 120*a*, 120*b* each have an end flange 124*a*, 124*b* extending inwardly toward the opposite tab 122*a*, 122*b*. The end flanges 124*a*, 124*b* extend such that the distance from the end of said flange to the opposite tab 122*a*, 122*b* is somewhat less than the diameter of the circular cross section of the pivot structures 110*a*, 110*b*. While said distance should be less than said diameter, it should not be so much less that the wall panels 108*a*, 108*b* cannot be snap fit onto the pivot structures 110*a*, 110*b*.

Figure 3:
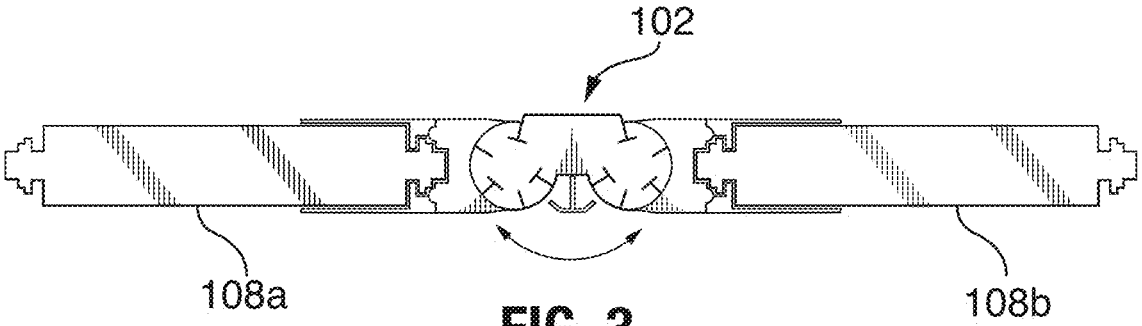
FIG. 3 is a top view of a pivot joint, tab connectors and partition wall panels of the partition system of FIG. 1, with the partition wall panels at 180 degrees to one another.

As mentioned above, the tabs 120*a*, 120*b*, 122*a*, 122*b* of wall panels 108*a*, 108*b* are adapted to snap fit onto the pivot structures 110*a*, 110*b*, as shown in FIG. 3. In particular, the partition wall panel 108*a*, 108*b* can be placed adjacent to the pivot structures 110*a*, 110*b*, such that the tabs 120*a*, 120*b*, 122*a*, 122*b* are in contact with the pivot structures 110*a*, 110*b*. By applying additional force on the wall panels 108*a*, 108*b*, directed inward toward the pivot structures 110*a*, 110*b*, the tabs 120*a*, 120*b* having flanges 124*a*, 124*b* deflect outward, away from the pivot structures 110*a*, 110*b*, thereby increasing the distance between flanges 124*a*, 124*b* and tabs 122*a*, 122*b*. Once said distance has increased sufficiently, pivot structures 110*a*, 110*b* will fit between tabs 120*a*, 122*a*, and tabs 120*b*, 122*b*, respectively, and the wall panels 108*a*, 108*b* will move forward into an engaged position, abutting the pivot structures 110*a*, 110*b*. At this point, the tabs 120*a*, 120*b* will have deflected back to their original position, and will extend forward past the apex of the circular cross-section of the pivot structures 110*a*, 110*b*. Flanges 124*a*, 124*b* will extend inward, beyond the apex of the circular cross section of the pivot structures 110*a*, 110*b*, thereby "gripping" said pivot structures. The flanges 124*a*, 124*b* can be in physical contact with the pivot structures 110*a*, 110*b* when in the engaged position, or can be spaced apart such that they will come into physical contact with pivot structure 110*a*, 110*b*, if the wall panels 108*a*, 108*b* are pulled away from said pivot structures.

Figure 4:
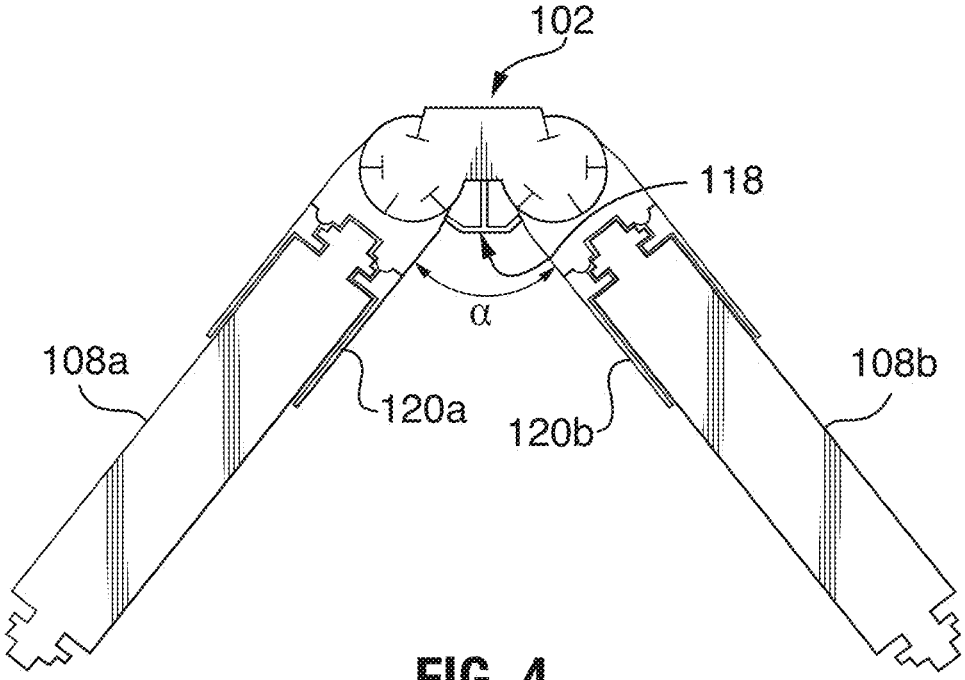
FIG. 4 is a top view of the pivot joint, tab connectors and partition wall panels of the partition system of FIG. 1, with the partition wall panels at 90 degrees to one another.

FIGS. 3 and 4 illustrate the range within which the wall panels 108*a*, 108*b* can be pivoted about the pivot axis 115 when the wall panels are in the engaged position. FIG. 3 is a top view of the pivot joint 102 and the wall panels 108*a*, 108*b*, where a relative angle α between the wall panels 108*a*, 108*b* is 180 degrees. FIG. 4 illustrates the wall panels 108*a*, 108*b* at 90 degrees to one another.

It will be appreciated that the range of possible relative angles α between the wall panels 108*a*, 108*b* is directly related to, and dictated by, the size and shape of the stop member 118. In the illustrated embodiment, the lengths of the perpendicular cross member 118*b* and the end flanges 118*c* dictate the minimum relative angle α between the wall panels 108*a*, 108*b*. By increasing or decreasing the length of cross member 118*b*, the minimum relative angle α will be decreased or increased, respectively. Increasing or decreasing the length of end flanges 118*c* will also decrease or increase the minimum relative angle α, respectively, although to a somewhat lesser extent than changes to the length of cross member 118*b*.

As mentioned previously, in the illustrated embodiment the tabs 120*a*, 120*b*, 122*a*, 122*b* are formed integrally with the tab connectors 109*a*, 109*b*. Tab connectors 109*a*, 109*b* include a connector means, for connecting the tab connectors 109*a*, 109*b* to the end faces 104 of the wall panels 108*a*, 108*b*. In the illustrated embodiments, and as shown in FIG. 5, the connector means of the tab connector 109*a* is a port 128*a*. The port 128*a* is an extruded metal structure defined by an opening 130*a* and stepped side walls 132*a*, 132*b* that provide multiple widths w1, w2, w3 within the port 128*a*. The stepped side walls 132*a*, 132*b* are connected to an inner wall 121*a* and an outer wall 123*a* by circular recesses 134*a*. The circular recesses 134*a*, 134*b* may be used to receive and hold cap castings, which will be explained in more detail below. Port 128*b* of tab connector 109*b* has a similar structure as port 128*a*.

In other embodiments, any other suitable means for connecting the tab connectors 109*a*, 109*b* to the end faces 104 of the wall panels 108*a*, 108*b* can be used. By way of example, the port 128*a* can be replaced with any other structure suitable for connecting inner wall 121*a* and outer wall 123*a*. Inner wall 121*a* and outer wall 123*a* can act as opposed connecting flanges (referred to above) that provide for a friction fit between the tab connector 109*a*, 109*b* and wall panel 108*a*, 108*b*, as described above.

In some embodiments, the tab connectors 109*a*, 109*b* are formed as metal extrusions, such as, but not limited to, an aluminum extrusion. In such embodiments, the tabs 120*a*, 120*b*, 122*a*, 122*b*, the port 128*a*, 128*b*, the cylindrical recesses 134*a*, 134*b*, the inner wall 121*a*, 121*b* and the outer wall 123*a*, 123*b* are all formed integrally as one piece of extruded aluminum.

Referring again to FIG. 2, each end frame member 106*a*, 106*b* has a port 146*a*, 146*b* located between an inner wall 142*a*, 142*b* and an outer wall 144*a*, 144*b* that has essentially the same structure as the port 128*a* shown in FIG. 5. The port 146*a*, 146*b* is connected to the inner wall 142*a*, 142*b* and the outer wall 144*a*, 144*b* by circular recesses 148*a*, 148*b*.

In some embodiments, the end frame members 106*a*, 106*b* are formed as metal extrusions, such as, but not limited to, aluminum extrusions. In such embodiments, the port 146*a*, 146*b*, the cylindrical recesses 148*a*, 148*b*, the inner wall 142*a*, 142*b* and the outer wall 144*a*, 144*b* are all formed integrally as one piece of extruded aluminum.

As mentioned previously, the ports 128*a*, 128*b*, 146*a*, 146*b* are shaped such that they can slide onto and secure the end faces 104 of the partition walls 108*a*, 108*b*. Since the ports 128*a*, 128*b* of the tab connectors 109*a*, 109*b* and the ports 146*a*, 146*b* of the end frame members 106*a*, 106*b* are of the same shape, they can be used interchangeably to secure the end faces 104 of the partition walls 108*a*, 108*b* depending on whether a pivot arm extrusion or an end frame member is required when assembling the partition system. In other words, the tab connectors 109*a*, 109*b* will be used when the end face 104 of the partition wall panel 108*a*, 108*b* will be joined to another wall panel. The end frame member 106*a*, 106*b* will be used when the end face 104 of the partition wall panel 108*a*, 108*b* is the end of the partition system.

It will be appreciated that end frame members 106*a*, 106*b* can be connected to partition walls 108*a*, 108*b* in any suitable manner, and in the same manner that tab connectors 109*a*, 109*b* are connected to partition walls 108*a*, 108*b*. By way of example, end frame members 106*a*, 106*b* can be connected to partition walls 108*a*, 108*b* by way of a friction fit with inner wall 142*a*, 142*b* and outer wall 144*a*, 144*b*, in the same manner that tab connectors 109*a*, 109*b* can be connected to partition walls 108*a*, 108*b* by way of a friction fit with opposed connecting flanges, such as inner wall 121*a* and outer wall 123*a*.

In embodiments where ports 128*a*, 128*b*, 146*a*, 146*b* are present, the profile of said ports may also be used to receive and hold mechanical fasteners within said ports, such as but not limited to, bolt heads and nuts.

Figure 6:
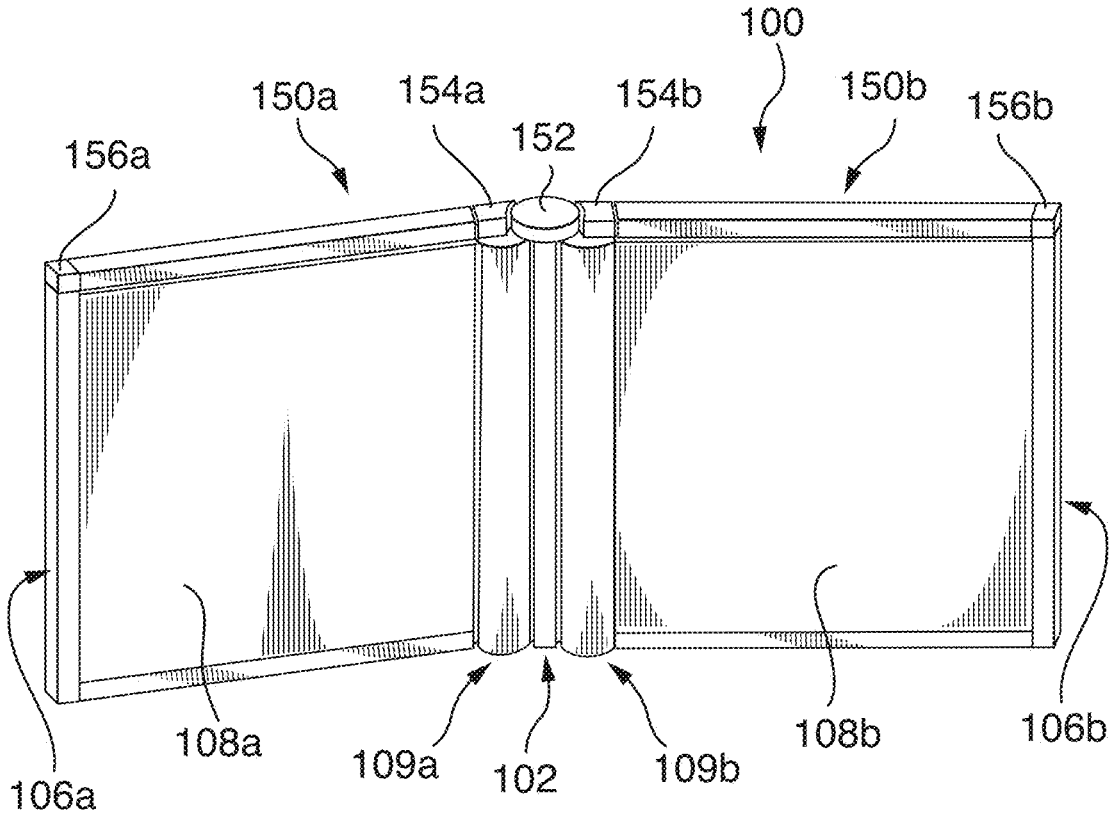
FIG. 6 is a perspective view of the partition system of FIG. 1, fully assembled.

FIG. 6 is a perspective view of the partition system, fully assembled. The pivot joint 102 is illustrated therein, connected to the two partition wall panels 108*a*, 108*b*. The end faces 104 are secured either to the tab connectors 109*a*, 109*b* or to the end frame members 106*a*, 106*b*. In this embodiment, the tab connectors 109*a*, 109*b* engage with the pivot joint 102. FIG. 6 further illustrates top frame members 150*a*, 150*b* that secure a respective top edge (not shown) of the partition wall panels 108*a*, 108*b*. The top frame members 150*a*, 150*b* have essentially the same structure as the end frame members 106, 106*b* shown in FIG. 2. In some embodiments, top frame members 150*a*, 150*b* are metal extrusions, such as, but not limited to, aluminum extrusions.

Figure 7:
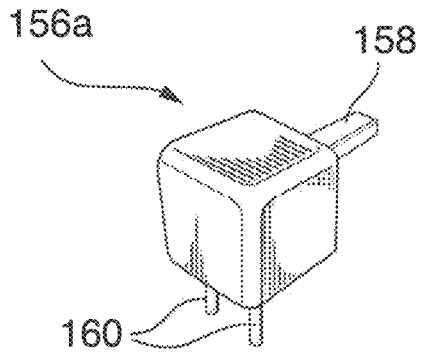
FIG. 7 is a perspective view of an end frame member cap of the partition system of FIG. 1.

The top frame members 150*a*, 150*b* are connected to the end frame members 106*a*, 106*b* by end frame member caps 156*a*, 156*b*. FIG. 7 is a perspective view of the end frame member cap 156*a*. The end frame member cap 156*a* has a square cross section with a first connecting peg 158 that is inserted into and connected to the port of the top frame member 150*a* using suitable fasteners. The end frame member cap 156*a* has additional connecting pegs 160 positioned at right angles to the first connecting peg 158. The additional connecting pegs 160 are received in the cylindrical recesses 148*a*, 148*b* of the end frame member 106*a*. End frame member cap 156*b* has a similar structure as end frame member cap 156*a* and connects end frame member 106*b* and top frame member 150*b* in a similar manner. In some embodiments, the end frame caps 156*a*, 156*b* are metal castings, such as, but not limited to, aluminum castings.

Figure 8:
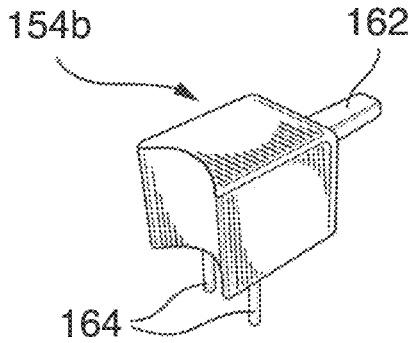
FIG. 8 is a perspective view of a tab connector cap of the partition system of FIG. 7.

Turning back to FIG. 6, tab connector caps 154*a*, 154*b* connect the top frame members 150*a*, 150*b* to the tab connectors 109*a*, 109*b*. As seen in FIG. 8, tab connector cap 154*b* has a rectangular cross section with a semicircular cutout to accommodate the pivot joint cap 152, which will be discussed in more detail below. Tab connector cap 154*b* has a first connecting peg 162 that is inserted into and connected to the port of the top frame member 150*b* using suitable fasteners. The tab connector cap 154*b* has additional connecting pegs 164 positioned at right angles to the first connecting peg 162. The additional connecting pegs 164 are received in the cylindrical recesses of the tab connector 109*a*. tab connector cap 154*a* has a similar structure as tab connector cap 154*b* and connects top frame member 150*a* and tab connector 109*b* in a similar manner.

Figure 9:
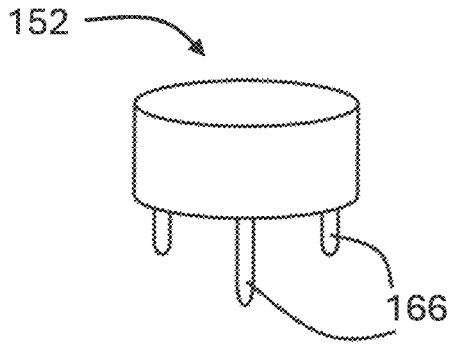
FIG. 9 is a perspective view of a pivot joint cap of the partition system of FIG. 7.

Referring again to FIG. 6, the pivot joint 102 has a pivot joint cap 152 that is more clearly illustrated in FIG. 9. The pivot joint cap 152 has an oval cross section with connecting pegs 166 that project downwardly from a bottom of the pivot joint cap 152. The connecting pegs 166 are received in slots formed by the internal flanges 110*c* of the two pivot structures 110*a*, 110*b* of the pivot joint 102.

Figure 10:
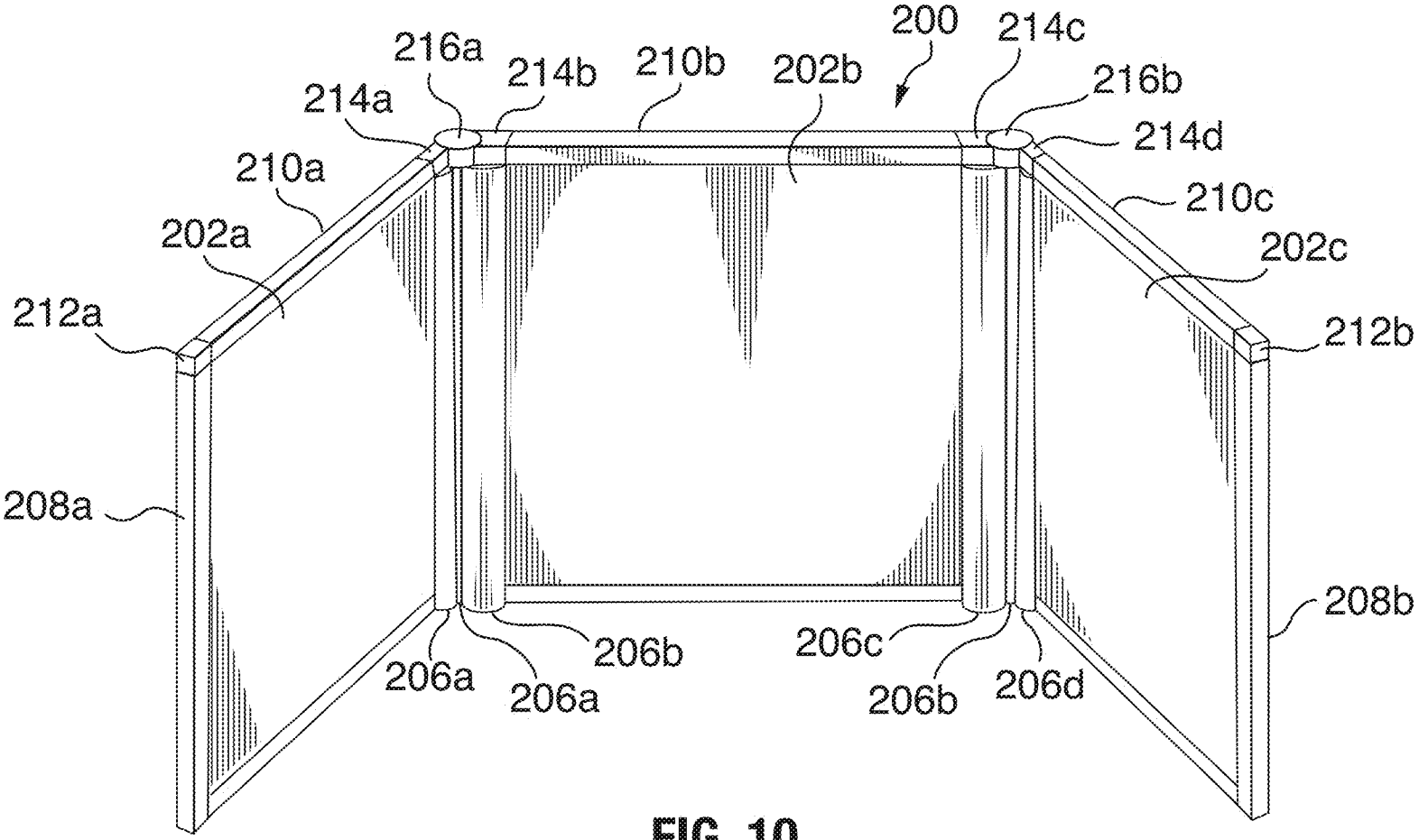
FIG. 10 is a perspective view of a partition system according to another embodiment of the present invention.

FIG. 10 is a perspective view of a partition system 200 according to another embodiment. In this embodiment, three partition wall panels 202*a*, 202*b*, 202*c* having similar structures as the partition wall panels in FIGS. 1 and 2 have end faces (not shown) that are secured by tab connectors 206*a*, 206*b*, 206*c*, 206*d* or by end frame members 208*a*, 208*b*. Tab connectors 206*a*, 206*b*, 206*c*, 206*d* engage pivot joints 204*a*, 204*b* having similar structures as the pivot joints in FIGS. 1 and 2. The three partition wall panels 202*a*, 202*b*, 202*c* are also framed by top frame members 210*a*, 210*b*, 210*c*. The end frame members 208*a*, 208*b* and top frame members 210*a*, 210*b*, 210*c* have similar structures as the end frame members shown in FIGS. 1 and 2. End frame member caps 212*a*, 212*b* having similar structures as the end frame member cap in FIG. 7 connect the end frame members 208*a*, 208*b* to the respective top frame members 210*a*, 210*c*. Tab connector caps 214*a*, 214*b*, 214*c*, 214*d* having similar structures as the tab connector cap in FIG. 8 connect the top frame members 210*a*, 210*b*, 210*c* to the respective tab connectors 206*a*, 206*b*, 206*c*, 206*d*. Pivot joint caps 216*a*, 216*b* having similar structures as the pivot joint cap in FIG. 9 are inserted into slots in the pivot joints 204*a*, 204*b*.

In at least one embodiment, it is contemplated that a plurality partition wall panels can be connected in series to one another at varying angles using multiple joints. The overall width and shape of the partition system may therefore be customized. An additional advantage of the partition system provided by the present disclosure is that the configuration of the partition system can be adjusted without having to disassemble any part of the system. Moreover, the partition system is easy to assemble given that the partition system comprises relatively few pieces. Fewer fasteners are required for the partition system of the present disclosure since the tab connectors attached to the end faces of the partition wall panels snap fit onto the pivot members, unlike existing partition systems.

It is further contemplated that more than one partition panel may be secured between the pivot joint and an end frame member, or between two pivot joints. For example, in one embodiment, two partition wall panels made of different materials are stacked one on top of the other. In another embodiment, two partition wall panels are stacked vertically with a slat wall in between the two partition wall panels for securing office equipment thereto.

The embodiments described herein are intended to be illustrative of the present compositions and are not intended to limit the scope of the present disclosure. Various modifications and changes consistent with the description as a whole and which are readily apparent to the person of skill in the art are intended to be included. The appended claims should not be limited by the specific embodiments set forth in the examples but should be given the broadest interpretation consistent with the description as a whole.

What is claimed is:

1. A pivot joint for pivotally connecting a first partition wall panel and a second partition wall panel, the pivot joint comprising:

two pivot structures each having a partial circular cross-section centered on a pivot axis, each of the two pivot structures configured to engage with a corresponding one of the first partition wall panel and the second partition wall panel via a snap fit and permitting the corresponding one of the first partition wall panel and the second partition wall panel to pivot about the associated pivot axis, each of the first partition wall panel and the second partition wall panel having an inwardly curved first end flange and an inwardly curved second end flange, the inwardly curved first end flange and the inwardly curved second end flange of each of the first partition wall panel and the second partition wall panel receiving and retaining a corresponding one of the two pivot structures when the corresponding one of the first partition wall panel and the second partition wall panel is snap fitted onto the corresponding one of the two pivot structures;

a linking structure extending between and joining the two pivot structures, the linking structure having an outer linking edge opposed from an inner linking edge, the outer linking edge having two longitudinal extending perimeter edges; and a stop member extending outwardly from the inner linking edge of the linking structure, the stop member having a proximal end adjoining the linking structure and a distal end spaced apart from the linking structure, the stop member having a perpendicular cross member at the distal end thereof, the stop member having a T-shaped cross-section and a pair of flanges extending from ends of the perpendicular cross member, the stop member limiting a range within which the corresponding one of the first partition wall panel and the second partition wall panel snap fitted onto the corresponding one of the two pivot structures can pivot about the pivot axis between a first position to a second position, the first partition wall panel and the second partition wall panel oriented generally colinear in the first position, the first partition wall panel angularly disposed to the second partition wall panel in the second position, wherein the inwardly curved first end flange of each of the first partition wall panel and the second partition wall panel abuts a corresponding one of the two longitudinally extending perimeter edges of the outer linking edge of the linking structure in the first position, and wherein a corresponding one of the pair of flanges of the stop member abuts a corresponding inwardly curved second end flange of each of the first partition wall panel and the second partition wall panel in the second position.

2. The pivot joint of claim 1, wherein the pivot joint is a metal extrusion.

3. The pivot joint of claim 2, wherein the metal extrusion is an aluminum extrusion.

4. A partition system comprising:

a plurality of wall panels;

at least one pivot joint, each at least one pivot joint comprising:

two pivot structures each having a partial circular cross-section centered on a pivot axis, each of the two pivot structures configured to engage with one of the plurality of wall panels and permitting the engaged one of a plurality of wall panels to pivot about associated the pivot axis;

a linking structure extending between and joining the two pivot structures, the linking structure having an outer linking edge opposed from an inner lining edge, the outer linking edge having two longitudinal extending perimeter edges; and a stop member extending outwardly from the inner linking edge of the linking structure, the stop member having a proximal end adjoining the linking structure and a distal end spaced apart from the linking structure, the stop member limiting a range within which the one of a plurality of wall panels engaged with one of the two pivot structures can pivot about the pivot axis, the stop member having a perpendicular cross member at the distal end thereof, the stop member having a T-shaped cross-section and a pair of flanges extending from ends of the perpendicular cross member; and wherein each of the plurality of wall panels has an inwardly curved first end flange and an inwardly curved second end flange, the inwardly curved first end flange and the inwardly curved second end flange of each of the plurality of wall panels receiving and retaining a corresponding one of the two pivot structures when a corresponding one of the plurality of the wall panels is snap fitted onto the corresponding one of the two pivot structures;

wherein each of the plurality of wall panels being pivotally connected to the corresponding one of the pivot structures of the at least one pivot joint, each of the plurality of wall panels pivotal about the pivot axis between a first position and a second position, at least two of the plurality of wall panels oriented generally colinear in the first position, at least two of the plurality of wall panels angularly disposed to one another in the second position, wherein the inwardly curved first end flange of each of the plurality of wall panels abuts a corresponding one of the two longitudinally extending perimeter edges of the outer linking edge of the linking structure in the first position, and wherein, each of the pair of flanges abuts the inwardly curved second end flange of each of the plurality of wall panels in the second position.

5. The partition system of claim 4, wherein the at least one pivot joint is a metal extrusion.

6. The partition system of claim 5, wherein the metal extrusion is an aluminum extrusion.

* * * * *